US005125997A

United States Patent [19]

Smith, Jr.

[11] Patent Number: 5,125,997

[45] Date of Patent: Jun. 30, 1992

[54] ADHESIVE APPLICATOR

[75] Inventor: Winfield W. Smith, Jr., West Warwick, R.I.

[73] Assignee: J. B. Prata, Ltd., Cranston, R.I.

[21] Appl. No.: 694,239

[22] Filed: May 1, 1991

[51] Int. Cl.[5] ..... B44C 1/165

[52] U.S. Cl. ..... 156/230; 156/238; 101/23

[58] Field of Search ..... 156/230, 187, 518, 247, 156/248, 249, 238, 590; 101/475, 381, 23, 25

[56] References Cited

U.S. PATENT DOCUMENTS

| | | | |
|---|---|---|---|
| 4,369,082 | 1/1983 | Kerwin | 156/238 |
| 4,484,970 | 11/1934 | Burzlaff et al. | 156/238 |
| 5,021,116 | 6/1991 | Milgram, Jr. et al. | 156/475 |

*Primary Examiner*—David A. Simmons
*Assistant Examiner*—Robert Barker
*Attorney, Agent, or Firm*—Barlow & Barlow, Ltd.

[57] ABSTRACT

Adhesive applicator in which an adhesive-coated tape is moved from one capstan to another, and a mandrel supporting a tubular core is advanced toward and away from the tape to apply adhesive to the outer surface of the core.

6 Claims, 2 Drawing Sheets

ADHESIVE APPLICATOR

BACKGROUND OF INVENTION

During the manufacture and distribution of tapes, an operation takes place in which the tape is wound on a hollow or tubular core. This core is usually made of cardboard, although plastic is used at times. In either case, the core has a smooth outer surface onto which the first layer of the tape must be laid in order to start the winding process. In the case of a tape whose inner surface has no adhesive, it is necessary to apply an adhesive to the core outer surface to cause the tape to adhere. This is true also with a type of tape whose inner surface does bear adhesive, but which adhesive is covered by a release sheet.

In the past, this adhesive has been applied manually with a brush, but this method is considerably less than satisfactory. To begin with, it is awkward to hold the core in one hand, while brushing with the other hand. Adhesive has a tendency to migrate not only to the hand that holds the core, but also to the hand holding the brush. Furthermore, the brushing method results in an uneven layer of adhesive that can result in problems during subsequent operations, including that of winding. For instance, in transporting a number of cores from the adhesive-application station to the winding station, an unstructured layer of adhesive can cause the cores to stick to one another and to the container in which they are carried. Another method that has been used in the past involves loading the cores on the rewind mandrel of a slitter, starting the machine, rotating the cores on the mandrel, and then using a tape application gun to transfer adhesive to the cores. If one attempted to apply the adhesive to the core while it is in the winding machine, it would not only take time from the actual winding operation, but also cause problems related to entry of adhesive into the machine and the accidental application to the completed coil of tape.

The prior art is replete with constructions for applying coatings or labels to articles during manufacture. One of the methods consists of carrying the coating or label on a moving belt and then advancing the article toward the belt and into contact with the coating or article on the belt. For instance, the U.S. Pat No. 4,484,574 of DeRusha shows the application of an adhesive layer to a foam tape, followed by winding the resultant combination into a roll. The U.S. Pat. No. 3,389,009 of McNulty teaches the continuous application of a coating to the surface of a conduit while passing its surface over a tape that carries the coating in a powdered form. The U.S. Pat. No. 4,484,970 of Burzlaff teaches the application of a decorative foil to an article by applying adhesive to the foil and then pressing the foil on the surface of the article. Similarly, in the U.S. Pat. No. 3,709,755 of Wochner labels are carried on a belt and a container is brought into contact with a label. The U.S. Pat. No. 3,816,207, of Robertson et al shows a design applied to a cylindrical article by running a tape over its surface and heat-pressing the design from the tape onto the article. The U.S. Pat. No. 4,713,128 of Kerwin shows an article mounted on a mandrel, while a tape that carries a decal moves past it and is moved toward the tape to bring the decal into adhering contact with the article.

The prior art systems are rather complicated and expensive and do not lend themselves to the application of adhesive to cores for tape rolls. In small tape-manufacture and winding facilities, it is desirable to have an adhesive applicator that is portable, so that it can be moved from place to place, but the prior art machines are designed for permanent installation. In many cases, the prior art machinery is automatic and, therefore, is capable of injuring the operator. These and other difficulties experienced with the prior art devices have been obviated in a novel manner by the present invention.

It is, therefore, an outstanding object of the invention to provide an adhesive applicator that facilitates the application of adhesive to a core surface in such a way that a uniform layer results.

Another object of this invention is the provision of an applicator for adhesive which is uncomplicated and combines the best features of manual and automatic operation.

A further object of the present invention is the provision of an adhesive applicator that is not dangerous to use.

A still further object of the invention is the provision of an adhesive coating machine that is light in weight and can be carried from one location to another without difficulty.

It is a further object of the invention to provide an adhesive application device that prepares cores in a particularly uniform manner for subsequent effective use in a winding machine.

Another object of the invention is the provision of an adhesive applicator which is simple and rugged in construction, which can be easily manufactured from readily-available materials, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the present invention relates to an applicator for use in applying adhesive to a tubular core, which core will subsequently be used for the winding of a roll of tape. The applicator is provided with a main support structure on which two capstans are mounted for rotation about spaced, parallel axes. A motor is connected to one of the capstans to cause an adhesive-coated tape to pass from one capstan to the other. A mandrel is mounted for rotation about an axis that is parallel to and spaced from the axes of the capstans. Means is provided to move the mandrel carrying a core toward and away the tape as the belt passes from one capstan to the other. Means is also provided to limit the movement of the tape to the times when the mandrel is adjacent or in contact with the belt.

More specifically, the mandrel is carried on one end of an arm, the other end of which is connected by a pivot to the support structure. Swinging the arm to bring the core toward contact with the adhesive-coated belt causes the arm to strike a limit switch to produce movement of the belt.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
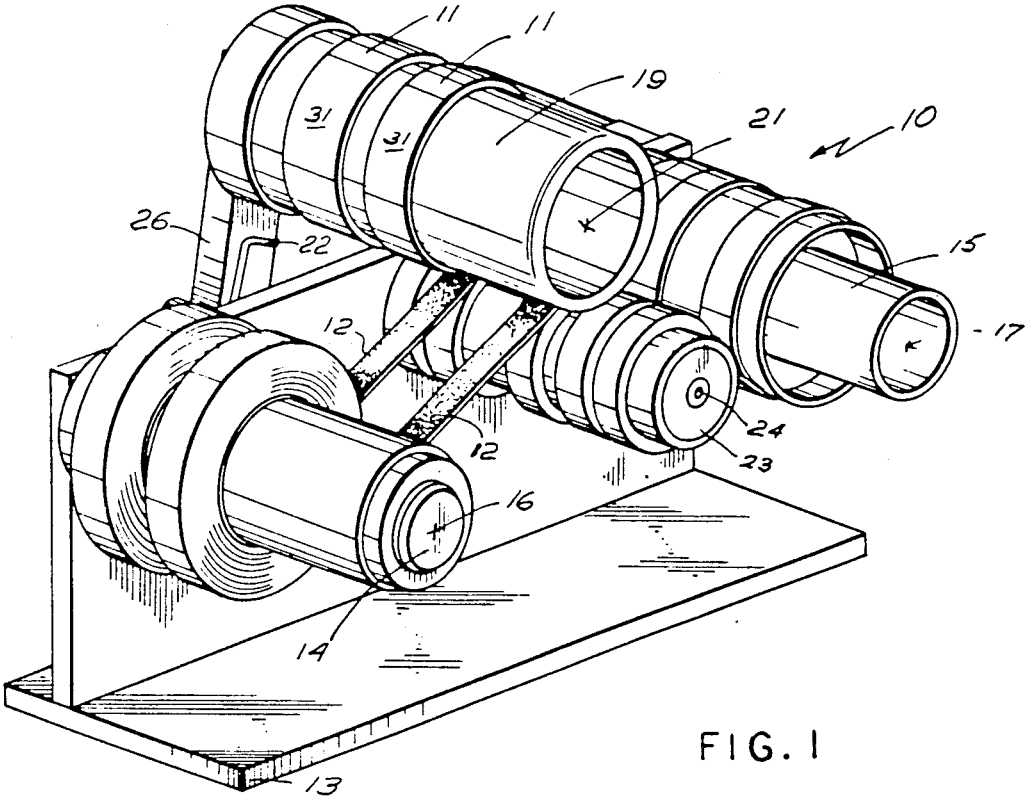
FIG. 1 is a perspective view of an adhesive applicator embodying the principles of the invention and shown in a inoperative mode.
Figure 2:
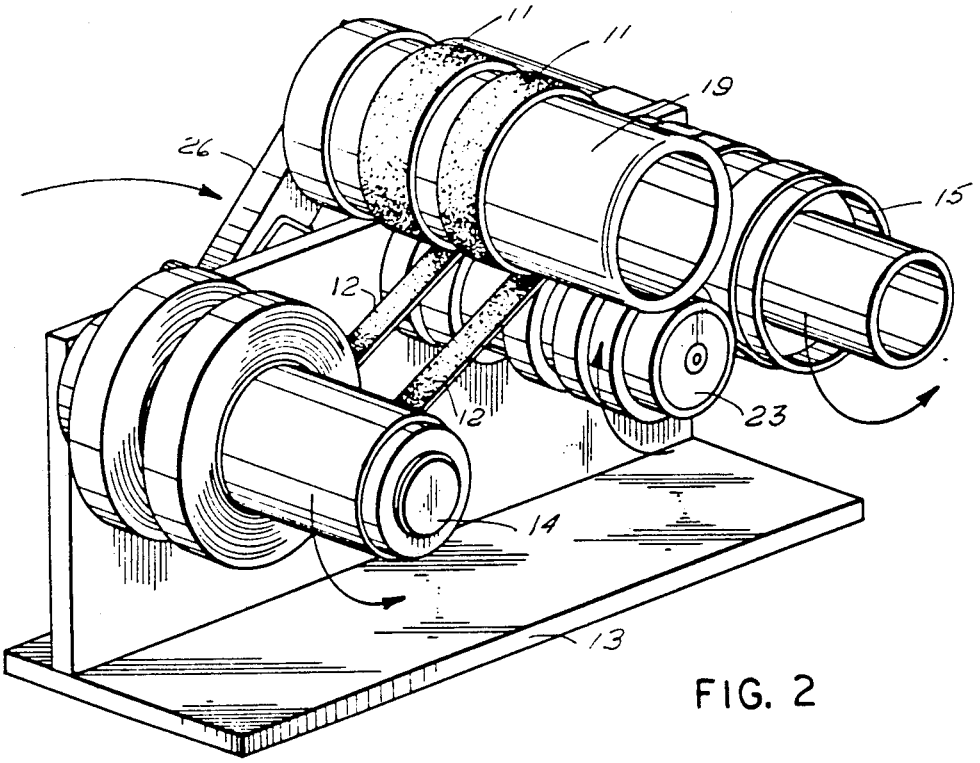
FIG. 2 is a perspective view of the invention showing it in an operative mode.

Referring first to FIG. 1, which best shows the general features of the invention, the adhesive applicator, indicated generally by the reference numeral 10, is shown in use in applying adhesive to a cardboard tubular core 11. This core will, after the adhesive is applied by contact with an adhesive-bearing belt or transfer tape 12, be moved to a winding machine (not shown), so that a tape can be wound on it. The tape with which it is to be used has no adhesive of its own on the inner surface (if at all) or, if it does have adhesive on the inner surface, it is covered with a release sheet, so that it is not sticky. In other words, it cannot be attached to the smooth outer surface of the core by causing the leading end to stick to it and proceeding with conventional winding.

Referring next to FIGS. 1-4, it can be seen that the applicator elements are mounted on a main support structure 13 having a vertical wall. Two capstans 14 and 15 are mounted on the support structure for rotation about spaced, parallel axes 16 and 17, respectively. An electric or air motor 18 is connected to the capstan 15 to cause the adhesive-coated tape 12 to pass from a roll on the capstan 14 to an accumulation roll on the driven capstan 15.

A mandrel 19 is mounted above the structure for rotation about an axis 21 that is parallel to and spaced from the tape 12 as it passes between the capstans. Means are, furthermore, provided to allow the mandrel to be moved by hand toward and away from the adhesive-coated tape.

An idler roll 23 lies between the capstans and is rotatable about an axis 24 that is parallel to the capstan axes and is in a position to be contacted by the mandrel when it is moved downwardly toward the tape. A means 25 is associated with the motor 18 for driving the tape from capstan to capstan only when the mandrel is moved toward and away from the tape.

Figure 3:
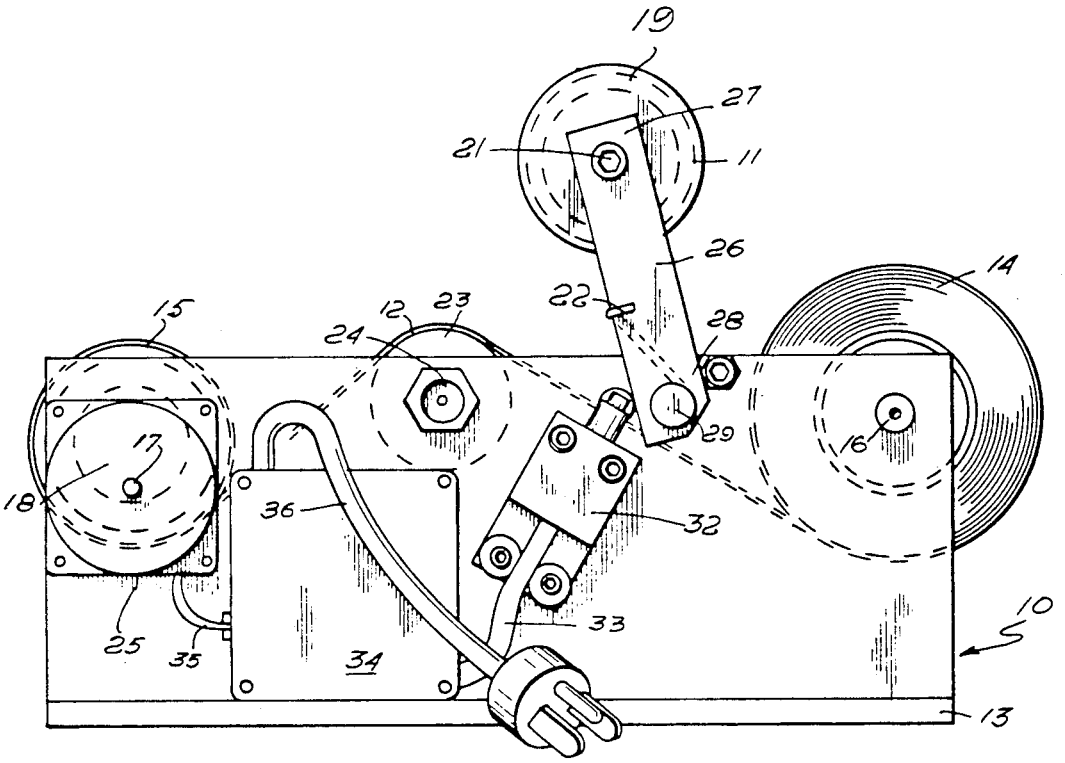
FIG. 3 is a rear elevational view of the invention.
Figure 4:
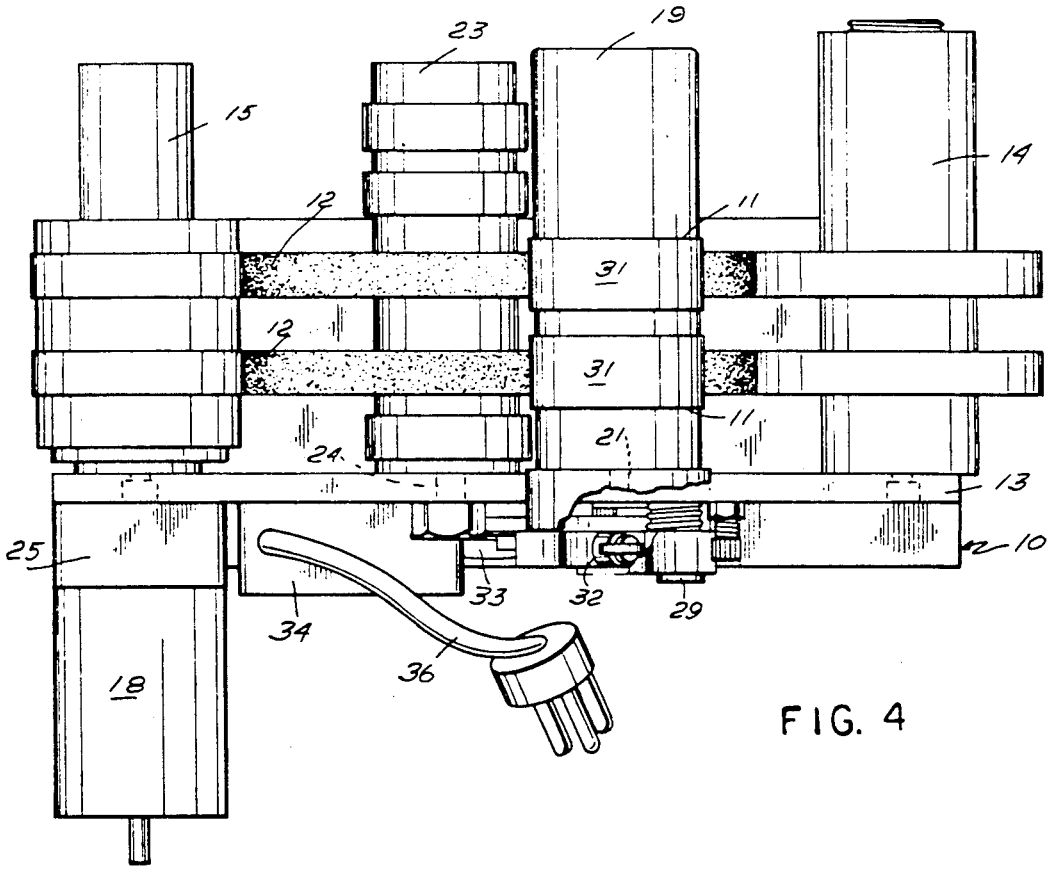
FIG. 4 is a top plan view of the invention.

As is most evident in FIG. 3, the mandrel 19 is carried on one end 27 of an arm 26 whose other end 28 is connected by a pivot pin 29 to the support structure.

FIG. 1 shows clearly that the mandrel 19 is cylindrical in shape and is sized to receive the tubular core 11, whose outer surface 31 is to receive adhesive from the tape 12. The core is free to rotate on the mandrel.

FIG. 3 shows the manner in which a limit switch 32 is located on the support structure to be contacted by the arm 26 as it swings about the pivot pin 29. The limit switch is connected by an electrical cable 33 to a junction box 34 where it is connected to a cable 35 leading to the motor 18 and to a cable 36 adapted to connect the junction box to an electrical source (not shown).

In the preferred embodiment, the tape 12 consists of a 2.0 mil layer of acrylic adhesive coated on a silicone coated kraft release liner that is 2.5 mil thick. The adhesive is specially formulated to achieve a balance of high shear, excellent tack, and good quick-stick properties. The adhesive is coated on a specially designed release paper, which paper is differentially coated on both sides for easy release with no risk of "confusion". The adhesive is capable of transferring easily and quickly to the paper core 11 at high speed.

The operation and advantages of the invention will now be easily understood in view of the above description. To begin with, the tape 12 carries a layer or coating of the adhesive that is to be applied to the core 11. The operator of the applicator first places a new core 11 (that is free of adhesive) on the mandrel 19, using, for instance, his right hand to do so. With his left hand, he grasps the arm 26 and swings it downwardly about the axis provided by the pivot pin 29. Eventually, the arm contacts the actuating roller of the limit switch 32, thus energizing the motor 18. The motor, therefore, drives the capstan 15 which pulls the adhesive-coated tape 12 from a roll mounted on the capstan 14 to an accumulation roll on the capstan 15. On its way from the capstan 14 to the capstan 15, the tape 12 passes over the idler roll 23.

When the mandrel moves downwardly, the outer surface 31 of the core eventually contacts the tape 12. Since the tape is moving longitudinally, friction causes the core to rotate in synchronization with the tape, i.e., at the same surface speed. When the core has made one complete rotation, it has received a complete coating of adhesive from the tape. The operator, observing this fact, moves the arm upwardly to remove the core from contact with the tape. As the arm moves further upwardly, it also leaves its contact with the limit switch 32 and the motor stops. Obviously, the design is selected so that, when the core contacts the tape, it does so directly over the idler roll. At that location, the tape 12 is passing over a substantial peripheral portion of the idler roll and this presents a nicely-curved surface for contact with the core. Theoretically, the contact is "linear" contact and this produces the maximum force between the core and tape, so that adhesive is transferred efficiently.

Since the motor 18 is energized only during the small portion of the swinging cycle of the arm 26 that exists just before, during, and just after contact of the core with the tape, only the amount of adhesive is removed from the tape that is necessary to completely coat the outer surface of the core. There will, as a practical matter, be small amounts of adhesive left on the tape that will pass to the driven capstan 15 and be wound on the accumulation roll, but the amount thus wasted will be negligible. Because the coating of adhesive on the tape 12 is evenly applied during the tape manufacture, it is capable of applying a coating that is similarly even on the outer surface of the core. This means that, when the core is subsequently placed on the winding machine, the operation of starting the winding of the product tape will take place in the same manner during each winding cycle. The quality of the finished roll on the core will not vary from core to core and the production of off-standard rolls will be reduced to a minimum.

It can be seen, also, that the simplicity of the present invention results in a light-weight machine that can be easily transported to various locations in a plant. Its operation is largely manually controlled, but the quality of adhesive application will not vary from core to core. Most importantly, however, is the fact that the adhesive will be applied in such a manner that the cores can be handled and transported without adhesive being released onto the operator's hands or onto the winding equipment. The entire tape winding operation is, therefore, improved; not only is the operation less laborintensive, but the quality of the finished product is improved.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Adhesive applicator for a tubular core, comprising (a) a main support structure, (b) two capstans mounted on the structure for rotation about spaced parallel axes, one capstan carrying a supply of adhesive coated tape, (c) a motor connected to one of the capstans to cause the adhesive-coated tape to move from one capstan to the other, (d) an arm, (e) a mandrel mounted for rotation about an axis that is parallel to and spaced from the axes of the capstans, (f) said mandrel carried on one end of said arm, the other end of which is connected by a pivot pin to the support structure, (g) means rocking said arm for moving the mandrel toward and away from the tape as it moves between the capstans, and an idler roll between the capstans rotatable about an axis parallel to the capstan axes and in a position to be contacted by the mandrel.

2. Adhesive applicator as recited in claim 1, wherein means is provided for driving the tape only when the mandrel is moved toward the tape.

3. Adhesive applicator as recited in claim 1, wherein the mandrel is cylindrical and is sized to receive a tubular core whose outer surface is to receive adhesive from the tape.

4. Adhesive applicator as recited in claim 1, wherein the swinging of the arm to move the mandrel toward and away from the tape causes the arm to contact a limit switch to produce moving and stopping of the tape.

5. Method of applying adhesive to the outer surface of a tubular core comprising the steps of:

(a) moving a stretch of adhesive-coated tape longitudinally from one point to another, (b) supporting the stretch of tape of an idler roll, (c) mounting the core on a mandrel for rotation, (d) bringing the mandrel toward the tape and idler roll so that the outer surface of the core contacts the tape and the tape contacts the idler roll, the contact of the tape with the core taking place on the surface of the tape opposite the surface that is in contact with the idler roll, whereby the mandrel is driven in synchronization with the tape movement.

6. Method as recited in claim 5, wherein the tape is moved only when the core is approaching, contacting, or leaving the tape.

* * * * *